US008851955B2

(12) United States Patent
Zhang

(10) Patent No.: US 8,851,955 B2
(45) Date of Patent: Oct. 7, 2014

(54) ROCKING INFLATABLE FIGURE

(71) Applicant: Gemmy Industries Corporation, Coppell, TX (US)

(72) Inventor: Cheng-Chun Zhang, Shenzhen (CN)

(73) Assignee: Gemmy Industries Corporation, Coppell, TX (US)

( * ) Notice: Subject to any disclaimer, the term of this patent is extended or adjusted under 35 U.S.C. 154(b) by 92 days.

(21) Appl. No.: 13/706,832

(22) Filed: Dec. 6, 2012

(65) Prior Publication Data

US 2014/0162527 A1 Jun. 12, 2014

(51) Int. Cl.

| | |
|---|---|
| ***A63H 3/20*** | (2006.01) |
| ***A63H 13/18*** | (2006.01) |
| ***A63H 3/06*** | (2006.01) |

(52) U.S. Cl.

CPC . *A63H 3/06* (2013.01); *A63H 13/18* (2013.01)
USPC ..... 446/330; 446/268; 446/176

(58) Field of Classification Search

USPC ..... 446/330, 220, 223, 226, 221, 176, 268; 74/25, 47, 42, 54, 570.1, 490.01, 74/490.03; 40/412

See application file for complete search history.

(56) References Cited

U.S. PATENT DOCUMENTS

| | | | | | |
|---|---|---|---|---|---|
| 3,260,016 | A * | 7/1966 | Goldfarb | ..... | 446/354 |
| 4,545,775 | A * | 10/1985 | Kim | ..... | 446/299 |
| 4,901,459 | A * | 2/1990 | Lee | ..... | 40/414 |
| 5,003,714 | A * | 4/1991 | Satoh et al. | ..... | 40/414 |
| 6,135,848 | A * | 10/2000 | Hou | ..... | 446/353 |
| 6,454,441 | B1 * | 9/2002 | Lin | ..... | 362/294 |
| 7,217,171 | B2 * | 5/2007 | Hsu et al. | ..... | 446/300 |
| 7,356,951 | B2 * | 4/2008 | Spielberger et al. | ..... | 40/412 |

* cited by examiner

*Primary Examiner* — Gene Kim
*Assistant Examiner* — Urszula M Cegielnik
(74) *Attorney, Agent, or Firm* — Rabin & Berdo, P.C.

(57) ABSTRACT

A rocking inflatable figure has a hollow inflatable body, a rocking mechanism and an air pump. The inflatable body has an air inlet, a movable portion and two partition diaphragms securely mounted on an inner wall inside the movable portion. The rocking mechanism is mounted between the two partition diaphragms and has a housing and an oscillating lever pivotally mounted on the housing. An electric motor and a transmission mechanism are mounted inside the housing. When the electric motor and the transmission mechanism drive the oscillating lever to keep oscillating, the two partition diaphragms on the movable portion rock relative to each other. Accordingly, the rocking inflatable figure can exhibit a continuously rocking form to increase the viewing fun and animated effect.

16 Claims, 7 Drawing Sheets

ROCKING INFLATABLE FIGURE

BACKGROUND OF THE INVENTION

1. Field of the Invention

The present invention relates to an inflatable figure and more particularly to a rocking inflatable figure.

2. Description of the Related Art

Inflatable figures are normally used for occasions of all kinds of exhibitions, carnivals and parties for the advertising, decorating and entertaining purposes.

Conventional inflatable figures are structurally simple and each of which has a hollow inflatable body and an air pump. The inflatable body has an air inlet formed through a bottom of the inflatable body. The air pump is mounted to align with the air inlet of the inflatable body so as to pump air into the inflatable body and expand the inflatable body. After being inflated, the inflatable body deployed at the sites of the foregoing occasions can deliver entertaining and amusing effect to the surrounding people.

However, conventional inflatable figures can be only statically exhibited and easily become stereotypical in terms of visual reception. Therefore, toy industry is constantly conceiving how to improve the design of inflatable figures by providing satisfactory entertaining and animated effect through added motion of the inflatable figures.

SUMMARY OF THE INVENTION

An objective of the present invention is to provide a rocking inflatable figure capable of presenting a continuously rocking form to increase the animated viewing fun.

To achieve the foregoing objective, the rocking inflatable figure has an inflatable body, a rocking mechanism and an air pump.

The inflatable body is hollow and has an air inlet, a movable portion and two partition diaphragms.

The air inlet is formed through the inflatable body.

Each partition diaphragm is securely mounted on an inner wall of the movable portion.

The rocking mechanism is mounted inside the movable portion of the inflatable body and between the two partition diaphragms, and has a housing, an oscillating lever, an electric motor and a transmission mechanism.

The housing is securely mounted inside the movable portion and on one of the partition diaphragms.

The oscillating lever has a distal end and a proximal end relative to the housing.

The distal end is securely connected to the other partition diaphragm.

The proximal end is pivotally mounted on the housing.

The electric motor is mounted inside the housing.

The transmission mechanism is mounted inside the housing and is connected with the electric motor and the oscillating lever for the electric motor to drive the transmission mechanism and for the transmission mechanism to drive the oscillating lever to continuously oscillate with respect to the pivot center of the oscillating lever.

The air pump is mounted inside the inflatable body and is aligned with the air inlet of the inflatable body.

The air pump of the rocking inflatable figure first pumps air into the inflatable body. After the electric motor starts, the electric motor drives the oscillating lever on the housing to oscillate. As the housing and the oscillating lever are securely mounted on the two partition diaphragms in the movable portion, the partition diaphragm securely mounted on the oscillating lever thereon continuously rocks relative to the partition diaphragm securely mounted on the housing when the oscillating lever keeps oscillating relative to the housing. Accordingly, the movable portion also presents a continuously rocking posture. Vendors of the rocking inflatable figures can tailor user's demand to design the movable portion as the waist, neck or the like of the figure to focus on the rocking effect of the upper portion or the head of the figure and increase the viewing fun of the inflatable figures.

Other objectives, advantages and novel features of the invention will become more apparent from the following detailed description when taken in conjunction with the accompanying drawings.

DETAILED DESCRIPTION OF THE INVENTION

Figure 1:
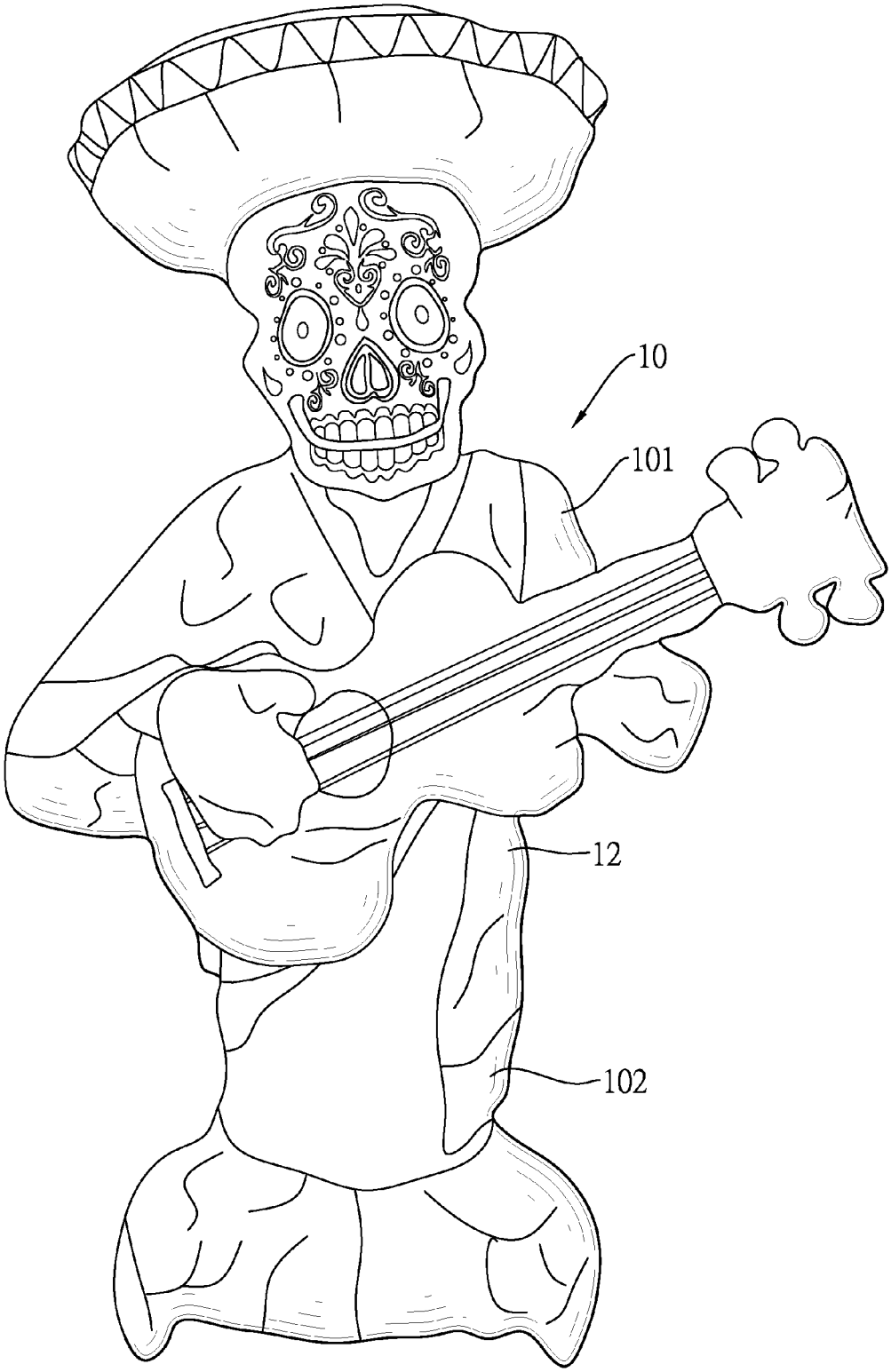
FIG. 1 is a perspective view of a rocking inflatable figure in accordance with the present invention.
Figure 2:
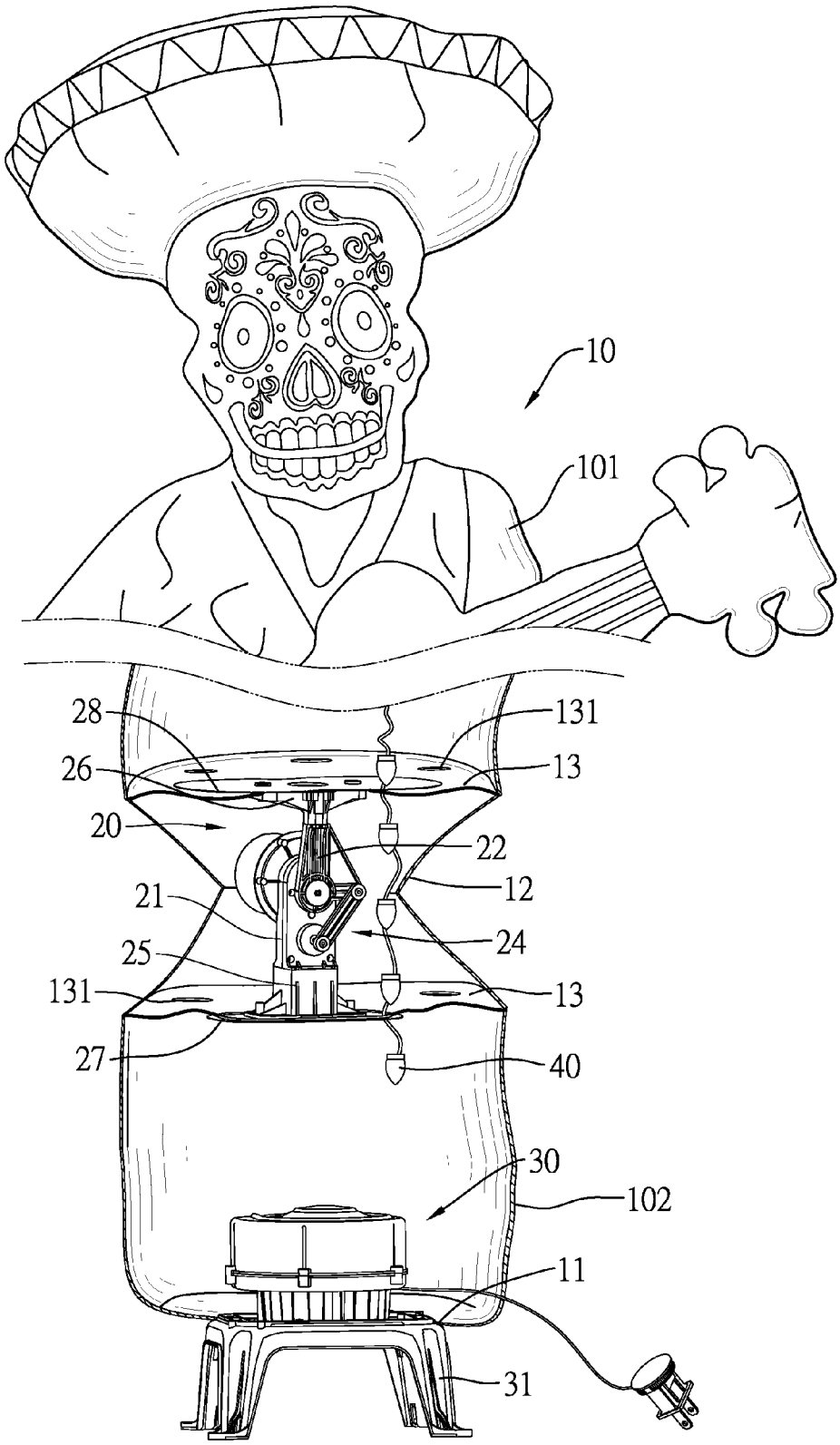
FIG. 2 is a front view in partial section of the rocking inflatable figure in FIG. 1.

With reference to FIGS. 1 and 2, a rocking inflatable figure in accordance with the present invention has an inflatable body 10, a rocking mechanism 20, an air pump 30 and a string light 40.

The inflatable body 10 is hollow and has an air inlet 11, a movable portion 12 and two partition diaphragms 13. In the present embodiment, the inflatable body 10 has an upper portion 101 and a lower portion 102. The movable portion 12 is formed between the upper portion 101 and the lower portion 102 and serves as a waist of the inflatable body 10. Each partition diaphragm 13 is securely mounted on an inner wall of the movable portion 12 and has multiple air vents 131 formed through the partition diaphragm 13. The air inlet 11 is formed through a bottom of the inflatable body 10.

Figure 3:
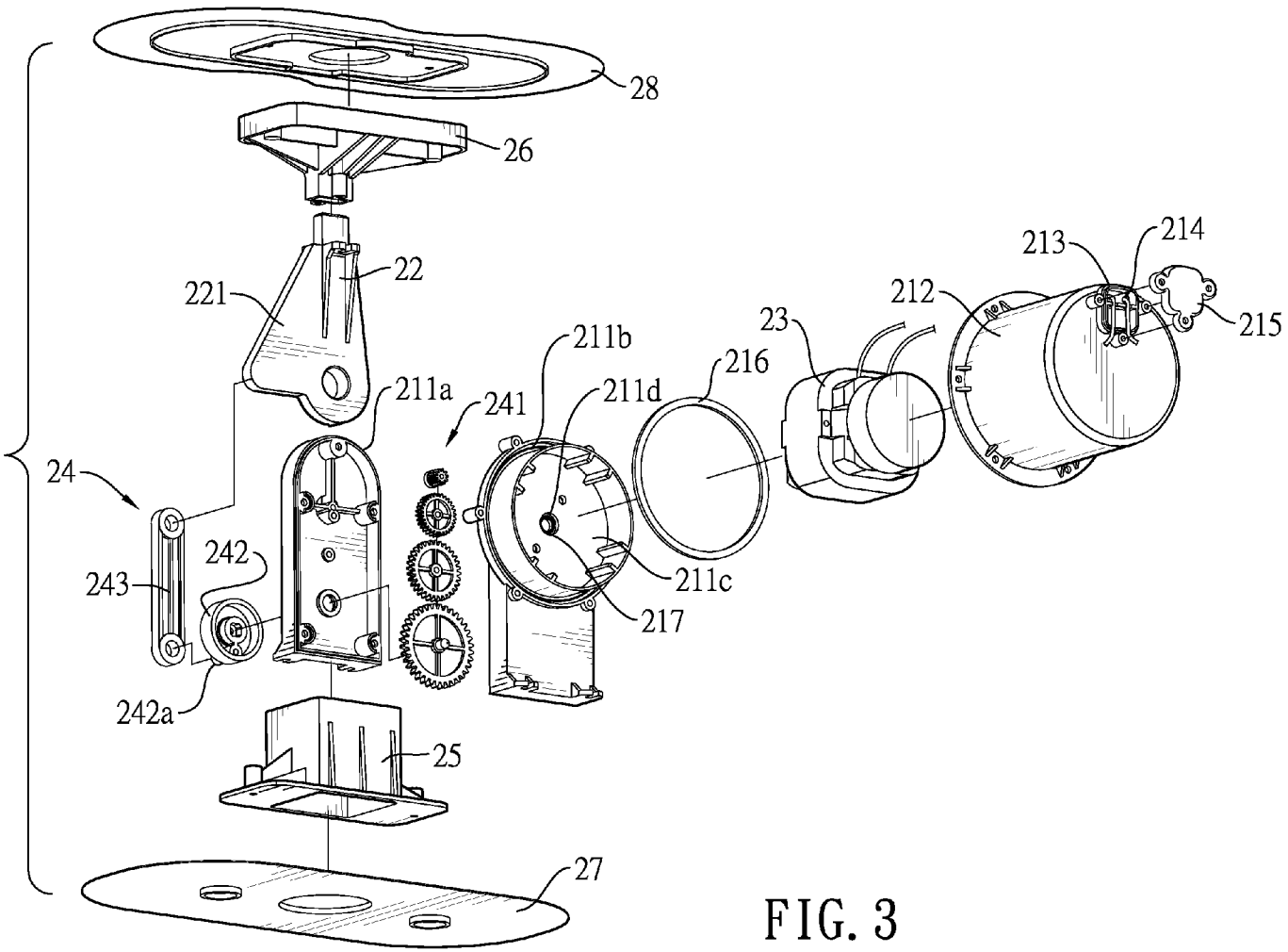
FIG. 3 is an exploded view of a rocking mechanism of the rocking inflatable figure in FIG. 2.

The rocking mechanism 20 is mounted inside the movable portion 12 of the inflatable body 10 and between the two partition diaphragms 13, and has a housing 21, an oscillating lever 22, an electric motor 23 and a transmission mechanism 24. The housing 21 is securely mounted inside the movable portion 12 and on one of the partition diaphragms 13. With reference to FIG. 3, the electric motor 23 and the transmission mechanism 24 are mounted inside the housing 21. One of two ends of the oscillating lever 22 distal to the housing 21 is securely connected to the other partition diaphragm 13. The other end of the oscillating lever 22 adjacent to the housing 21 is pivotally mounted on the housing 21. The electric motor 23 is connected with the transmission mechanism 24. The transmission mechanism 24 is connected with the oscillating lever 22. The electric motor 23 drives the transmission mechanism 24 so that the transmission mechanism 24 drives the oscillating lever 22 to continuously oscillate with respect to a pivot center of the oscillating lever 22.

The air pump 30 is mounted inside the inflatable body 10 and is aligned with the air inlet 11 of the inflatable body 10. In the present embodiment, the air pump 30 is mounted on a seat 31.

The string light 40 is mounted inside the inflatable body 10.

The rocking mechanism 20 further has two fixing bases 25, 26 and two flexible plates 27, 28. Each fixing base 25, 26 is securely mounted on one of the housing 21 and the oscillating lever 22 and abuts against a surface of a corresponding partition diaphragm 13 facing the fixing base 25, 26. Each flexible plate 27, 28 is mounted on a surface of a corresponding partition diaphragm 13 opposite to a corresponding fixing base 25, 26. Hence, each partition diaphragm 13 is held by a corresponding flexible plate 27, 28 and a corresponding fixing base 25, 26 so that the housing 21 and the oscillating lever 22 are fastened on the partition diaphragms 13.

Figure 4:
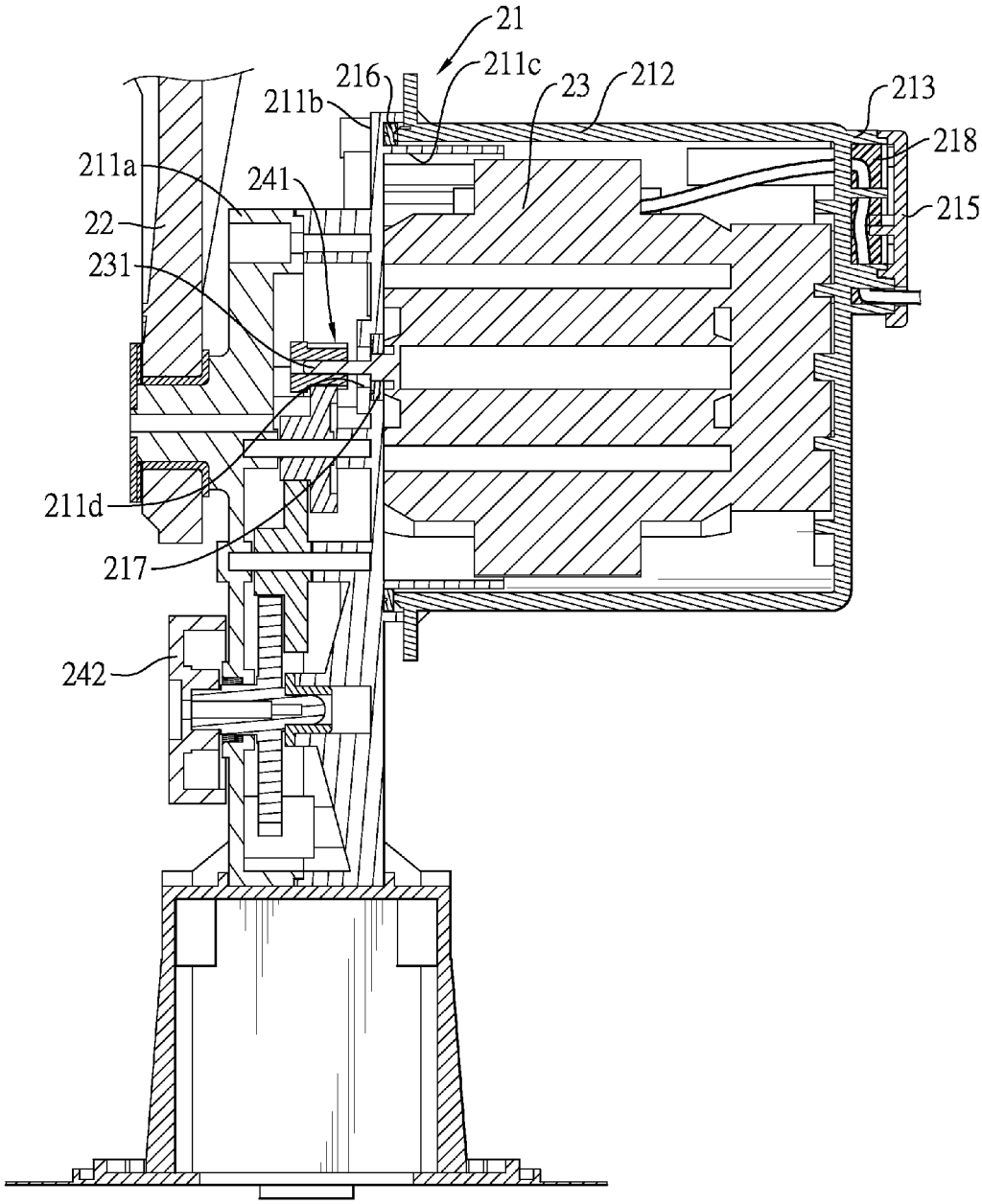
FIG. 4 is a partially cross-sectional side view of the rocking mechanism in FIG. 3.

With reference to FIGS. 3 and 4, a detailed structure of the rocking mechanism 20 is described as follows.

The oscillating lever 22 has a side wing 221. The electric motor 23 has a spindle 231. The transmission mechanism 24 has a reduction gear assembly 241, an eccentric wheel 242 and a push rod 243.

The reduction gear assembly 241 is rotatably mounted inside the housing 21, is connected with the spindle 231 of the electric motor 23, and is driven by the electric motor 23. The eccentric wheel 242 is connected with the reduction gear assembly 241, is rotated by the reduction gear assembly 241, and has an eccentric shaft 242*a*.

One end of the push rod 243 is pivotally mounted on the eccentric shaft 242*a*, and the other end of the push rod 243 is pivotally mounted on the side wing 221 of the oscillating lever 22. When the eccentric wheel 242 is rotated, the push rod 243 drives the side wing 221 and the oscillating lever 22 to oscillate with respect to the pivot center of the oscillating lever 22.

The housing 21 has a gearbox and a motor cover 212. The gearbox has two half cases 211*a*, 211*b* jointed together. The reduction gear assembly 241 is rotatably mounted inside the two half cases 211*a*, 211*b*. One of the half cases 211*b* has a motor holder 211*c* formed on a periphery of the half case 211*b*. The electric motor 23 is mounted in the motor holder 211*c*. The motor holder 211*c* has a spindle hole 211*d* for the spindle 231 of the electric motor 23 to connect with the reduction gear assembly 241 in the gearbox through the spindle hole 211*d*.

The motor cover 212 corresponds to and is mounted on the motor holder 211*c* to cover the electric motor 23 within the motor holder 211*c* and the motor cover 212. In the present embodiment, the motor cover 212 has a power wire box 213. The power wire box 213 is formed on the periphery of the motor cover 212 with one side open and has two wire holes 214 and a lid 215. The wire holes 214 are formed through the power wire box 213 and the motor cover 212 for power wires to connect with the electric motor 23 through the respective wire holes 214. The lid 215 is mounted on the power wire box 213 to cover the power wire box 213.

To prevent the electric motor 23 from being damaged by rain penetration into the motor holder 211*c* when the rocking inflatable figure is mounted outdoors, a first waterproof seal ring 216 and a second waterproof seal ring 217 are respectively mounted between the motor holder 211*c* and the motor cover 212 and inside the spindle hole 211*d* of the housing 21. The motor cover 212 abuts against the first waterproof seal ring 216 on the perimeter of the inner bottom of the motor holder 211*c*. The spindle 231 of the electric motor 23 is sleeved in the second waterproof seal ring 217 abutting against an inner wall of the spindle hole 211*d* of the housing 21. A waterproof adhesive layer 218 is mounted inside the power wire box 213 to cover the wire holes 214.

Figure 5:
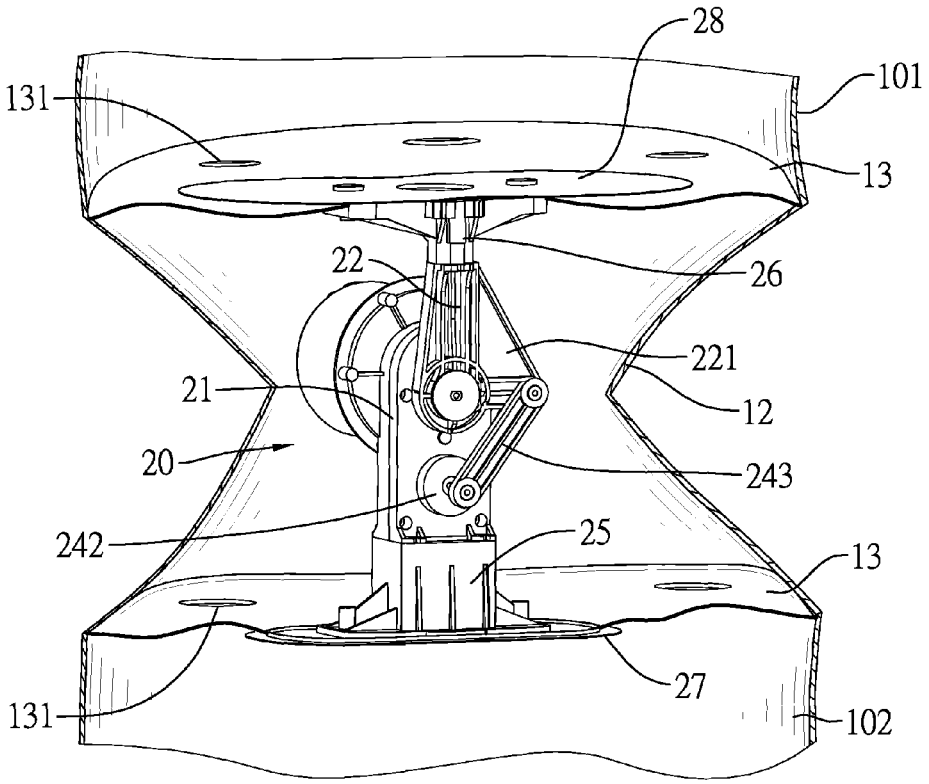
FIG. 5 is a first enlarged operational side view in partial section of the rocking inflatable figure in FIG. 2.
Figure 6:
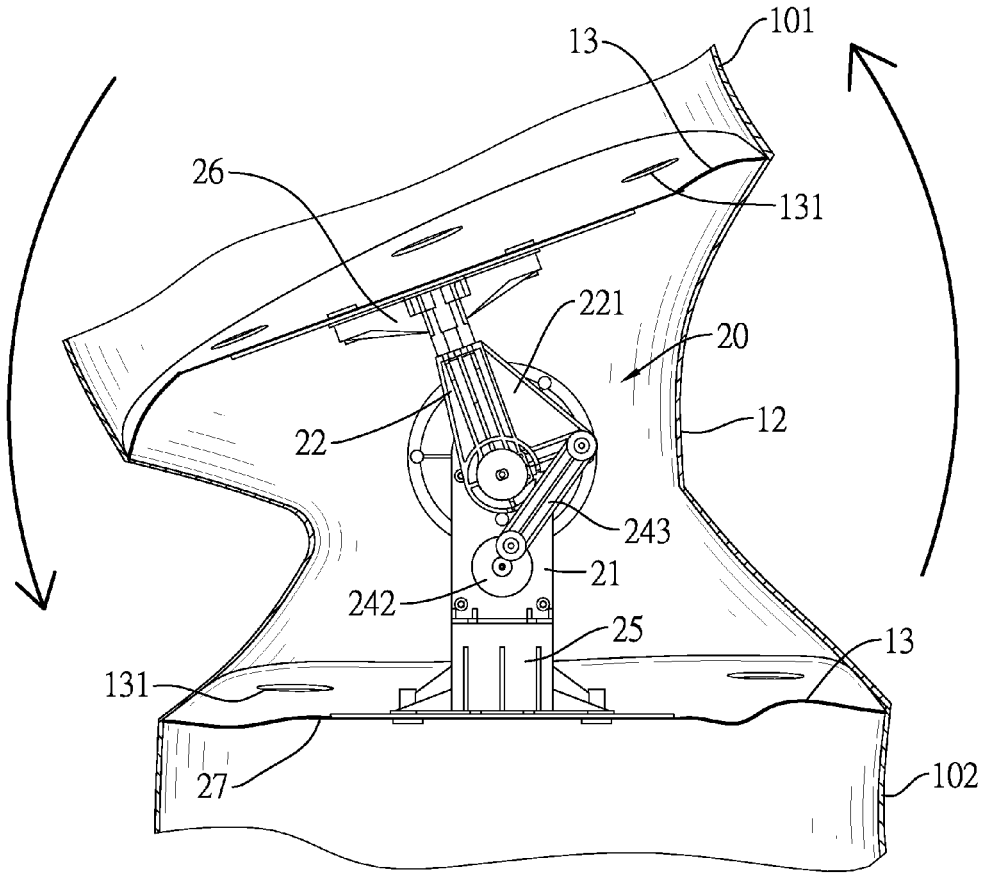
FIG. 6 is a second enlarged operational side view in partial section of the rocking inflatable figure in FIG. 2.
Figure 7:
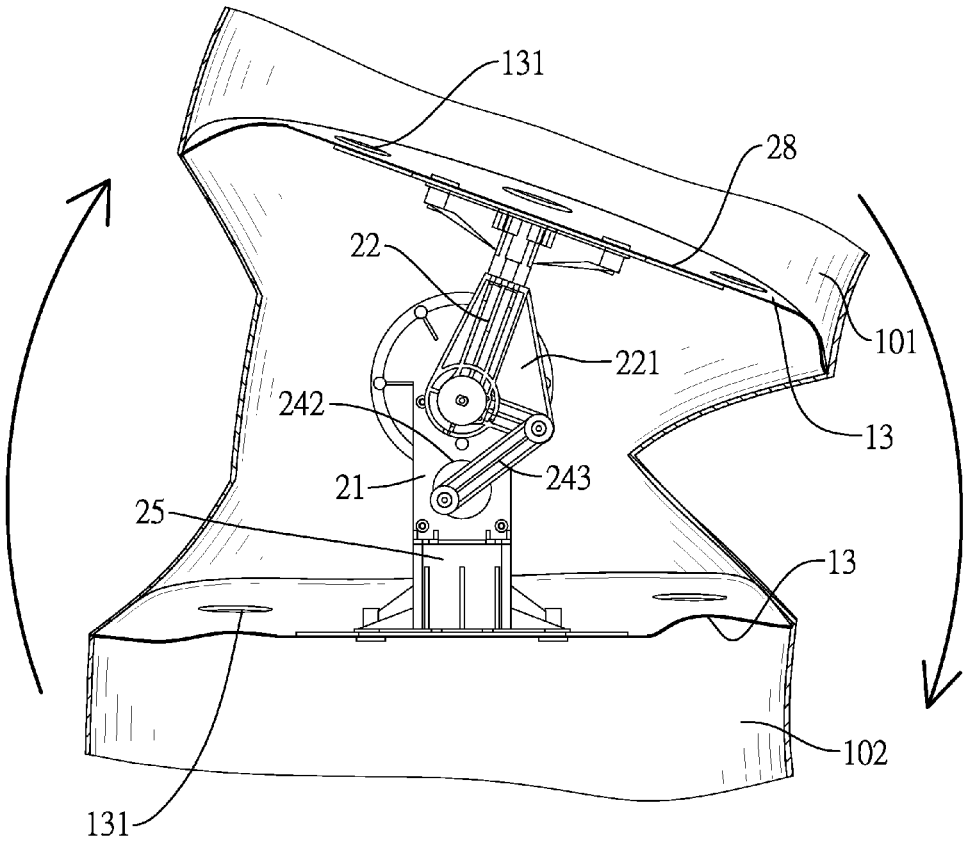
FIG. 7 is a third enlarged operational side view in partial section of the rocking inflatable figure in FIG. 2.

With reference to FIGS. 5 to 7, when the electric motor 23 drives the reduction gear assembly 241 and the reduction gear assembly 241 drives the eccentric wheel 242 to rotate, the push rod 243 pivotally mounted on the eccentric shaft 242*a* of the eccentric wheel 242 repeatedly pushes the side wing 221 of the oscillating lever 22 so that the oscillating lever 22 keeps oscillating with respect to the pivot center of the oscillating lever 22. Hence, the oscillating lever 22 can oscillate back and forth relative to the partition diaphragm 13 with the housing 21 fixed thereon. In the present embodiment, in the event that the waist of the rocking inflatable figure is considered as the movable portion 12, the upper portion 101 can rock itself back and forth relative to the lower portion 102 and present an animated rocking effect. Similarly, in the event that the neck of the rocking inflatable figure is considered as the movable portion 12, the head of the rocking inflatable figure can present an animated rocking effect. The string light 40 mounted inside the inflatable body 10 illuminates the figure for the purpose of nighttime activities and colorful light exhibition. As the air pump 30 is mounted on a bottom of the inflatable body 10, air can be pumped upwards through the movable portion 12 between the upper portion 101 and the lower portion 102 of the inflatable body 10. Each partition diaphragm 13 has multiple air vents 131 for air to pass therethrough so as to inflate the upper portion 101 of the inflatable body 10.

In sum, besides exhibiting a continuously rocking form to increase an entertaining and decorative effect, the rocking inflatable figure can be also used for nighttime activities to satisfy different users' demands.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A rocking inflatable figure comprising:

an inflatable body being hollow and having:

an air inlet formed through the inflatable body;

a movable portion; and two partition diaphragms, each of the partition diaphragms being securely mounted on an inner wall of the movable portion;

a rocking mechanism mounted inside the movable portion of the inflatable body and between the two partition diaphragms, and having:

a housing securely mounted inside the movable portion and on one of the partition diaphragms;

an oscillating lever having two ends and a side wing, wherein one of the ends of the oscillating lever is distal to the housing and is securely connected to the other partition diaphragm, the other end of the oscillating lever is adjacent to the housing and is pivotally mounted on the housing, and the side wing is formed on the oscillating lever;

an electric motor mounted inside the housing and having a spindle; and a transmission mechanism mounted inside the housing, connected with the electric motor and the oscillating lever for the electric motor to drive the transmission mechanism and for the transmission mechanism to drive the oscillating lever to continuously oscillate with respect to a pivot center of the oscillating lever, and having:

a reduction gear assembly rotatably mounted inside the housing, connected with the spindle of the electric motor, and driven by the electric motor;

an eccentric wheel connected with the reduction gear assembly, rotated by the reduction gear assembly, and having an eccentric shaft; and a push rod having two ends, wherein one of the ends of the push rod is pivotally mounted on the eccentric shaft, and the other end of the push rod is pivotally mounted on the side wing of the oscillating lever, when the eccentric wheel is rotated, the push rod drives the side wing and the oscillating lever to oscillate with respect to the pivot center of the oscillating lever; and an air pump mounted inside the inflatable body and aligned with the air inlet of the inflatable body.

2. The rocking inflatable figure as claimed in claim 1, wherein the housing has:

a gearbox having two half cases jointed together, wherein the reduction gear assembly is rotatably mounted inside the two half cases, one of the half cases has a motor holder formed on a periphery of the one half case, the electric motor is mounted in the motor holder, the motor holder has a spindle hole for the spindle of the electric motor to connect with the reduction gear assembly in the gearbox through the spindle hole; and a motor cover corresponding to and mounted on the motor holder to cover the electric motor within the motor holder and the motor cover.

3. The rocking inflatable figure as claimed in claim 2, wherein the inflatable body has an upper portion and a lower portion;

the movable portion is formed between the upper portion and the lower portion; and each of the partition diaphragms has multiple air vents formed through the partition diaphragm.

4. The rocking inflatable figure as claimed in claim 2, wherein the motor cover has a power wire box, formed on a periphery of the motor cover, with an open side and having:

two wire holes formed through the power wire box and the motor cover for power wires to connect with the electric motor through the respective wire holes; and a lid mounted on the power wire box to cover the open side of the power wire box.

5. The rocking inflatable figure as claimed in claim 4, further comprising:

a first waterproof seal ring mounted between the motor holder and the motor cover;

a second waterproof seal ring mounted inside the spindle hole of the housing, the motor cover abuts against the first waterproof seal ring on a perimeter of an inner bottom of the motor holder, the spindle of the electric motor is sleeved in the second waterproof seal ring abutting against an inner wall of the spindle hole of the housing; and a waterproof adhesive layer mounted inside the power wire box to cover the wire holes.

6. The rocking inflatable figure as claimed in claim 4, wherein the inflatable body has an upper portion and a lower portion;

the movable portion is formed between the upper portion and the lower portion; and each of the partition diaphragms has multiple air vents formed through the partition diaphragm.

7. The rocking inflatable figure as claimed in claim 1, wherein the inflatable body has an upper portion and a lower portion;

the movable portion is formed between the upper portion and the lower portion; and each of the partition diaphragms has multiple air vents formed through the partition diaphragm.

8. The rocking inflatable figure as claimed in claim 5, wherein the inflatable body has an upper portion and a lower portion;

the movable portion is formed between the upper portion and the lower portion; and each of the partition diaphragms has multiple air vents formed through the partition diaphragm.

9. The rocking inflatable figure as claimed in claim 1 further comprising a string light mounted inside the inflatable body.

10. The rocking inflatable figure as claimed in claim 9, wherein the housing has:

a gearbox having two half cases jointed together, wherein the reduction gear assembly is rotatably mounted inside the two half cases, one of the half cases has a motor holder formed on a periphery of the one half case, the electric motor is mounted in the motor holder, the motor holder has a spindle hole for the spindle of the electric motor to connect with the reduction gear assembly in the gearbox through the spindle hole; and a motor cover corresponding to and mounted on the motor holder to cover the electric motor within the motor holder and the motor cover.

11. The rocking inflatable figure as claimed in claim 9, wherein the inflatable body has an upper portion and a lower portion;

the movable portion is formed between the upper portion and the lower portion; and each of the partition diaphragms has multiple air vents formed through the partition diaphragm.

12. The rocking inflatable figure as claimed in claim 10, wherein the inflatable body has an upper portion and a lower portion;

the movable portion is formed between the upper portion and the lower portion; and each of the partition diaphragms has multiple air vents formed through the partition diaphragm.

13. The rocking inflatable figure as claimed in claim 10, wherein the motor cover has a power wire box, formed on a periphery of the motor cover, with an open side and having:

two wire holes formed through the power wire box and the motor cover for power wires to connect with the electric motor through the respective wire holes; and a lid mounted on the power wire box to cover the open side of the power wire box.

14. The rocking inflatable figure as claimed in claim 13, wherein the inflatable body has an upper portion and a lower portion;

the movable portion is formed between the upper portion and the lower portion; and each of the partition diaphragms has multiple air vents formed through the partition diaphragm.

15. The rocking inflatable figure as claimed in claim 13, further comprising:

a first waterproof seal ring mounted between the motor holder and the motor cover;

a second waterproof seal ring mounted inside the spindle hole of the housing, the motor cover abuts against the first waterproof seal ring on a perimeter of an inner bottom of the motor holder, the spindle of the electric motor is sleeved in the second waterproof seal ring abutting against an inner wall of the spindle hole of the housing; and a waterproof adhesive layer mounted inside the power wire box to cover the wire holes.

16. The rocking inflatable figure as claimed in claim 15, wherein the inflatable body has an upper portion and a lower portion;

the movable portion is formed between the upper portion and the lower portion; and each of the partition diaphragms has multiple air vents formed through the partition diaphragm.

* * * * *